US009377761B2

(12) United States Patent
Zachmann et al.

(10) Patent No.: US 9,377,761 B2
(45) Date of Patent: Jun. 28, 2016

(54) ILLUMINATION ARRANGEMENT FOR A TIMEPIECE

(71) Applicant: Timex Group USA, Inc., Middlebury, CT (US)

(72) Inventors: Helmut Zachmann, Remchingen (DE); Thomas Oberhofer, Pforzheim (DE); Claudia Reiling, Pforzheim (DE)

(73) Assignee: TIMEX GROUP USA, INC., Middlebury, CT (US)

( * ) Notice: Subject to any disclaimer, the term of this patent is extended or adjusted under 35 U.S.C. 154(b) by 40 days.

(21) Appl. No.: 14/199,157

(22) Filed: Mar. 6, 2014

(65) Prior Publication Data

US 2015/0253734 A1 Sep. 10, 2015

(51) Int. Cl.
*G04B 19/30* (2006.01)
*G04B 19/14* (2006.01)

(52) U.S. Cl.
CPC ..... *G04B 19/30* (2013.01); *G04B 19/14* (2013.01)

(58) Field of Classification Search
CPC .... G04B 19/30; G04B 19/32; G04B 45/0015; G04B 19/14; G04C 17/02
USPC ..... 368/67, 226, 227
See application file for complete search history.

(56) References Cited

U.S. PATENT DOCUMENTS

| | | | | |
|---|---|---|---|---|
| 4,250,575 | A | 2/1981 | Flumm | |
| 5,604,716 | A * | 2/1997 | Cheung | 368/67 |
| 5,805,533 | A | 9/1998 | Daigle et al. | |
| 5,984,485 | A * | 11/1999 | Poli et al. | 362/23.15 |
| 6,452,872 | B1 * | 9/2002 | Teijido et al. | 368/67 |
| 6,682,201 | B2 | 1/2004 | Kneer et al. | |
| 7,063,429 | B2 * | 6/2006 | Hirano et al. | 362/23.15 |
| 7,095,463 | B2 * | 8/2006 | Usui et al. | 349/61 |
| 8,169,858 | B2 | 5/2012 | Klopfenstein et al. | |
| 8,488,418 | B2 | 7/2013 | Blanckaert et al. | |
| 2009/0109801 | A1 * | 4/2009 | Winkler | 368/67 |

FOREIGN PATENT DOCUMENTS

| | | |
|---|---|---|
| GB | 2 052 114 | 1/1981 |
| JP | 2004-279098 | 10/2004 |
| JP | 2006-226867 | 8/2006 |
| JP | 2008-111848 | 5/2008 |

* cited by examiner

*Primary Examiner* — Vit W Miska
(74) *Attorney, Agent, or Firm* — Carmody Torrance Sandak & Hennessey LLP

(57) ABSTRACT

A timepiece including at least one display hand for conveying information in an analog manner, the timepiece including a dial, the dial having a front side and a rear side, wherein the at least one display hand is positioned on the front side of the dial, and wherein the timepiece comprises an illumination assembly, positioned on the rear side of the dial, for illuminating the dial, wherein the illumination assembly includes a transparent ring into which light can be introduced, around and through which light can pass; at least one concentrated light source for introducing light into the transparent ring; light directing means, located on at least one of the inner and the outer periphery of the transparent ring, for directing light out of the transparent ring and towards the dial, whereby the light directed out of the transparent ring by the light directing means illuminates the dial.

11 Claims, 2 Drawing Sheets

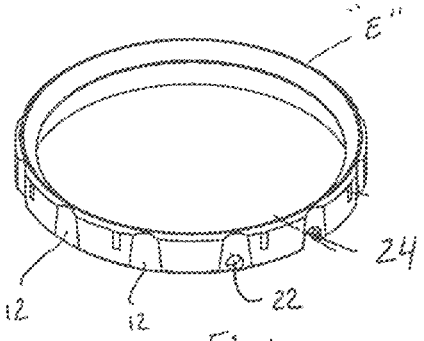
Fig 1
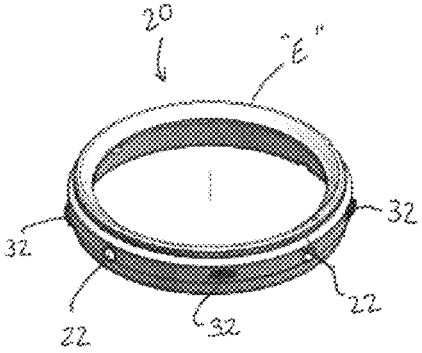
Fig 2
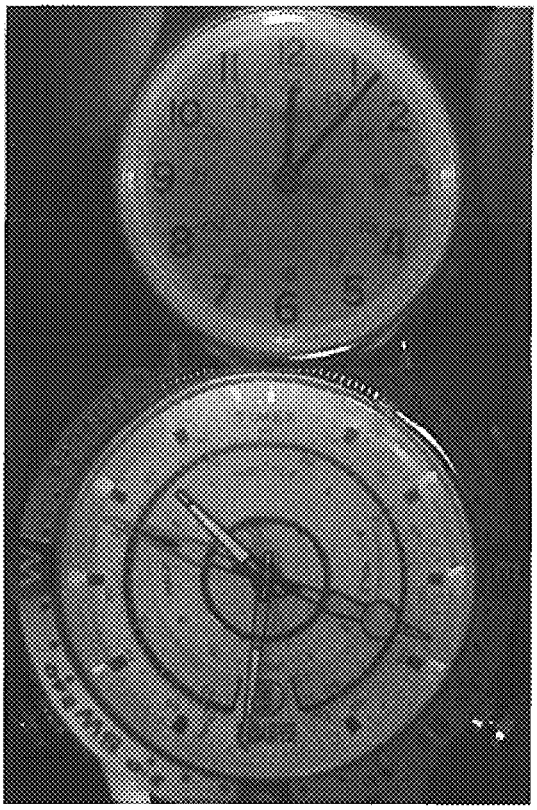
Fig 5
Fig 4

ILLUMINATION ARRANGEMENT FOR A TIMEPIECE

BACKGROUND OF THE INVENTION

This invention relates generally to illumination arrangements for instrument dials and more particularly to an improved illumination arrangement for a dial of an analog timepiece, such as a wristwatch in a preferred embodiment.

It is known to provide instruments such as wristwatches with a light source for illuminating the dial. The wristwatch dial may be an analog wristwatch dial having indicia or markers used in combination with hands of the wristwatch, or the dial may comprise an electro-optic display of actuated indicia, such as a liquid crystal display. It is both an objective and challenge in any dial illumination arrangement to achieve a constant and uniform lighting of the dial. Uniform background lighting may be achieved by using a distributed uniform light source, such as an electroluminescent light source. However, in order to reduce the cost of an illumination system for a dial, concentrated light sources, such as a single incandescent bulb or a light emitting diode (LED), have also been considered. One problem with using a concentrated light source is to effectively transfer and diffuse the point source of bright light to a uniformly distributed light for illuminating the dial. The prior art contains many examples of such efforts.

For example, U.S. Pat. Nos. 3,748,456; 2,140,972; 2,188,821; 2,480,393; 3,043,038; and 3,561,145 are examples of prior art constructions for illuminating dials. U.S. Pat. Nos. 4,250,575 and 6,682,201 as well as GB 2 052 114; JP2004-279098; JP2006-226867 and JP2008-111848 are also examples of varying prior art examples of dial illumination arrangements.

However, the state of the art has perceived deficiencies. For example, the distribution of light has been found to be less than uniform. Second, there can be significant non-uniformity of illumination nearest the lamp or other light source. Third, there is also perceived deficiencies where such light sources are mounted and positioned in the prior art. For example, an advantage of the present invention is the positioning of the concentrated light source on the rear side of the dial, for example, mounted on the printed circuit board, while the light itself is required on the front side of the dial. Moreover, prior art examples of concentrated light sources are known to create light spots, which is also less than desirable. Although known solutions in the prior art include the use of multiple light sources, this too is less than desirable for obvious reasons.

It can therefore be seen that it has been particularly difficult to effectively and uniformly conduct light from a concentrated source located beneath the watch dial through a light guide and out of the light guide above the dial. Space within the timepiece is also an important criterion to consider, and previously known constructions have also been less than satisfactory in this regard.

Another example of a light guide for illuminating a dial is described in U.S. Pat. No. 6,183,099, but here too, the present inventors believe that improvements can be made. This U.S. Pat. No. 6,183,099 also itself cites numerous prior art examples of dial illumination assemblies.

Accordingly, an improved illumination arrangement for a dial of a timepiece, and a wristwatch in particular, that overcomes the drawbacks found in the prior art while at the same time provides for a desirable and uniform distribution of illumination, is desired.

SUMMARY AND OBJECTIVES OF THE PRESENT INVENTION

Generally speaking, in accordance with the present invention, an illumination assembly for illuminating a dial of a timepiece is provided. In accordance with a preferred embodiments, the illumination assembly comprises a transparent ring into which light can be introduced, and around and through which light can pass; at least one concentrated light source for introducing light into the transparent ring; light directing means, located on at least one of the inner and outer periphery of the transparent ring, for directing light out of the transparent ring and towards the dial, whereby the light directed out of the transparent ring by the light directing means illuminates the dial.

In another preferred embodiment, a timepiece that comprises at least one display hand for conveying information in an analog manner is provided, with the timepiece of the preferred embodiments comprising a dial, the dial having a front side and a rear side, wherein the at least one display hand is positioned on the front side of the dial, and wherein the timepiece comprises an illumination assembly for illuminating the dial, wherein the illumination assembly comprises a transparent ring into which light can be introduced, around and through which light can pass, wherein the transparent ring is positioned around the periphery of the dial, extending from the rear side of the dial to the front side of the dial; at least one concentrated light source for introducing light into the transparent ring; light directing means, located on at least one of the inner and the outer periphery of the transparent ring, for directing light out of the transparent ring and towards the dial, whereby the light directed out of the transparent ring by the light directing means illuminates the dial.

In preferred embodiments, the light directing means comprises geometries in at least one of the inner and the outer periphery of the transparent ring to selectively eject light passing within the transparent ring. For example, the light directing means may comprise cut-out regions in at least one of the inner and the outer periphery of the transparent ring to selectively eject light passing within the transparent ring. Alternatively, the light directing means may comprise apertures in at least one of the inner and the outer periphery of the transparent ring to selectively eject light passing within the transparent ring. Still further, the light directing means may comprise geometries in the form of protrusions formed on at least one of the inner and the outer periphery of the transparent ring to selectively eject light passing within the transparent ring. In a specific embodiment, the cut-out regions (and/or the apertures and/or the protrusions) are in the outer periphery of the transparent ring to selectively eject light passing within the transparent ring.

In another specific embodiment, the transparent ring comprises an integrally molded support shoulder about an inner periphery thereof for supporting the dial. And preferably, the concentrated light source is a light emitting diode.

Accordingly, it is an object of the present invention to achieve a desired illumination of light for a dial for a timepiece, such as a wristwatch.

It is also an object of the present invention to achieve a uniform distribution of light using a concentrated or point light source and conducting the light through a light guide for illuminating a dial.

Another object of the present invention is to construct a timepiece with an illumination arrangement that is relatively easy to manufacture.

Another object of the present invention is to construct a light guide for use in the timepiece, such as a wristwatch, that accommodates manufacturing tolerances existing among the other timepiece components.

Still another object of the present invention is to construct an improved illumination arrangement that includes features that more effectively and efficiently directs the light and reduces or eliminates any "hot-spots" existing near the concentrated light source.

Yet another object of the present invention is to provide geometries within the light guide, such as apertures, cutouts and/or protrusions, to assist in creating a uniform distribution of illumination of the watch dial and overcoming the deficiencies noted above.

Still yet another object of the present invention is to construct a timepiece with an illuminating arrangement that is more efficient than prior technologies yet can be realized at a significantly reduced cost.

Still yet another object of the present invention is to be able to provide an illumination arrangement that can utilize differing LEDs that can thus provide differing colors of illumination.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a transparent ring constructed in accordance with a first embodiment of the present invention;

FIG. 2 is a perspective view of a transparent ring constructed in accordance with a second embodiment of the present invention;

FIGS. 4 and 5 are top plan views of actual timepieces illuminated by illumination assemblies constructed in accordance with the present invention, and comprising a transparent ring as disclosed herein with respect to FIGS. 1 and 2 and being constructed consistent with FIG. 3.

Like numbers to identify like parts and features will be used among the various figures, but not all features will be specifically identified in each illustration.

DETAILED DESCRIPTION OF THE PREFERRED EMBODIMENTS

Figure 3:
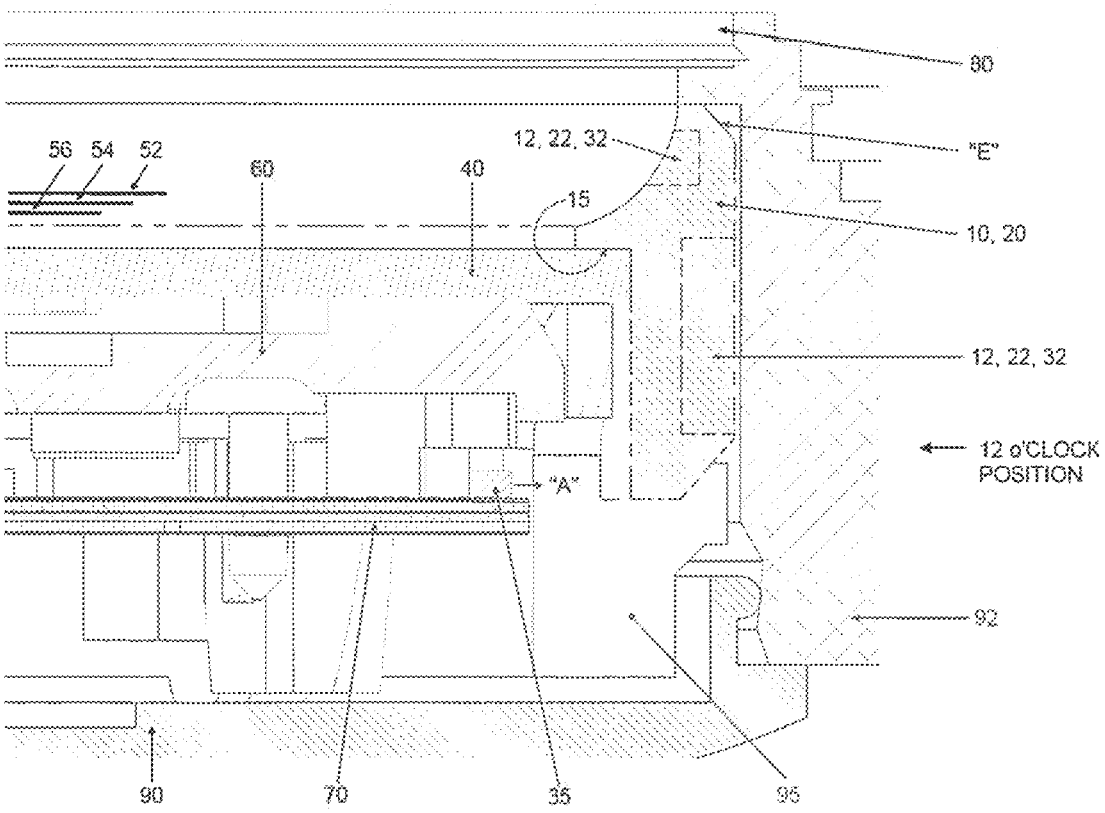
FIG. 3 is a cross-sectional view of a portion of a timepiece constructed in accordance with preferred embodiments of the present invention.

Generally speaking, and as noted above, many prior art illumination arrangements suffer from the deficiency whereby watches with point source illumination, such as LED illumination, create unfavorable light spots on one part of the dial while at the opposite end of the dial the illumination is insufficient, or in turn may suffer from an increased cost and assembly effort due to the use of multiple LEDs arranged around the dial.

The present invention overcomes this and other deficiencies in the prior art by utilizing a light guide comprising a transparent ring with high light-transitivity and reflection rate. In a preferred embodiment, the ring may be mounted on the printed circuit board ("PCB") and extend upwardly to the area between the dial and crystal.

Preferably, geometries, such as radial holes, cut-outs and/or protrusions are provided along the outer and/or inner diameters of the ring. Such geometries may be arranged along the main axes of the watch, e.g. at the 3 o'clock, 6 o'clock, 9 o'clock and 12 o'clock positions, or may alternatively be positioned at each hour-position. Other particular and specific positioning arrangements of the geometries are also contemplated herein and within the scope of the invention.

Light from the concentrated light source leaves the transparent ring preferably at these radial holes, cutouts or protrusions, with the desirable effect being small light spots at the locations of such radial holes, cutouts or protrusions. The result is that light is very evenly and homogeneously distributed about the dial, while emanating from only a single concentrated light source, which is preferably in the form of a light emitting diode ("LED").

To be sure however, the present invention contemplates, as does the claims herein, the use of a plurality of LEDs should the design and/or spacing constraints require or permit, as the case may be. In this way, the preferred and desired light spots can also be integrated into the dial design. The present invention also permits the use of different colored LEDs, so as to change the illumination for different timepiece products. As will also be disclosed herein, the transparent ring of the present invention can also provide the function of a support ring so that no extra or separate support ring will be needed.

In this way, the present invention is able to be advantageously multi-functional. For example, the present invention provides for even and desirable light distribution and can even simulate the use of multiple LEDs with a single light source, thereby providing meaningful design cost savings. The present invention also provides for improved aesthetic watch designs, as well as more efficient and more homogeneous light illumination.

Reference is thus now made first to FIGS. 1 and 2, each of which illustrates a transparent ring, generally indicated at 10 and 20 respectively, constructed in accordance with preferred embodiments of the present invention. Each of the transparent rings 10, 20 can be seen to comprise light directing means to selectively eject light passing within the transparent ring. For example, both transparent rings 10 and 20 can be seen to comprise geometries, generally indicated at 12, 22, 32 respectively, molded into at least one of the inner and the outer periphery of the transparent ring to selectively eject light passing within the transparent ring.

More specifically, the geometries of FIG. 1 can be seen to comprise cut-out regions 12 in the outer periphery of the transparent ring 10 for selectively directing light out of the transparent ring 10, 20. To be sure, although not illustrated for brevity, the cut-out regions 12 can likewise be positioned in the inner periphery of the transparent ring 10 to selectively eject light out of the transparent ring.

Alternatively, FIG. 2 illustrates that transparent ring 20 comprises a plurality of apertures 22 in the outer periphery of the transparent ring 20 for selectively directing light out of the transparent ring. And again, although not illustrated for brevity, the apertures 22 can likewise be positioned in the inner periphery of the transparent ring 20 to selectively direct light out of the transparent ring.

Still further and alternatively, FIG. 2 also illustrates that transparent ring 20 may comprise a plurality of protrusions 32 formed on the outer periphery of the transparent ring 20 for selectively directing light out of the transparent ring. And again, although not illustrated for brevity, the protrusions 32 can likewise be positioned on the inner periphery of the transparent ring 20 to selectively direct light out of the transparent ring.

As yet further alternatives, the embodiments can each respectively comprise cut-out regions 12 in both the inner and outer peripheries of the transparent ring 10, apertures 22 in both the inner and outer peripheries of the transparent ring 20, or protrusions 32 formed on both the inner and outer peripheries of the transparent ring 20, or either transparent ring 10 or 20 may comprise a combination of cut-out regions 12, apertures 22, and/or protrusions 32, as illustrated in FIGS. 1 and 2. Such are only design choices made by those skilled in the art. Sufficient spacing and/or a hole 24 may of course be provided in ring 10, 20 for the crown assembly (not shown). However, whether cut-outs, apertures or protrusions are used, whether a combination thereof are used and/or whether one or more of such cut-outs, apertures or protrusions are positioned on the inner and/or outer peripheries, it is to noted that such cut-outs, apertures or protrusions are to be arranged about the transparent ring 10, 20 in a particular configuration as disclosed herein, and by known molding techniques or otherwise. That is, such cut-outs, apertures and/or protrusions are to be deliberately and specifically (i.e. not randomly) positioned about the ring to maximize the desired illumination amount, effect and intensity about and on the dial. One skilled in the art would understand how to achieve this result without undue experimentation.

In both embodiments of FIGS. 1 and 2, light is introduced into the transparent ring 10, 20 and such light can pass through and around the ring. Preferably, the transparent ring 10, 20 is positioned around the periphery of the dial, extending on the rear side of the dial and on the front side of the dial. In other words, the ring preferably extends below the dial and above the dial, as is clearly illustrated in FIG. 3.

Reference is therefore now made to FIG. 3 in particular, which illustrates a cross-sectional view of a portion of a timepiece, generally indicated at 30, constructed in accordance with preferred embodiments of the present invention. Preferably, timepiece 30 will have at least one display indicator in the form of a display hand, thus being understood as an "analog timepiece." It should be understood that the embodiment of FIG. 3 is applicable and can accommodate either of the transparent rings of FIGS. 1 and 2. Therefore, it should be understood that FIG. 3 is intended to and be understood as including both transparent rings 10, 20, although not at the same time as only one transparent ring is utilized per timepiece.

Timepiece 30 also comprises at least one concentrated light source 35 for introducing light into the transparent ring 10, 20. As noted in FIG. 3, the transparent ring 10, 20 has one or more of the light directing means of FIGS. 1 and/or 2 located on at least one of the inner and outer peripheries of the transparent ring 10, 20. Generically, FIG. 3 illustrates that transparent rings 10, 20 may contain cut-out regions 12, apertures 22, and/or protrusions 32, either alone or in combination, on either or both of the inner and outer periphery thereof, and either above the dial, below the dial, or both. In any configuration herein disclosed, such light directing means direct light out of the transparent ring 10, 20 and towards the dial. In this way, the light directed out of the transparent ring by the light directing means illuminates the dial.

To this end, timepiece 30 comprises a dial, generally indicated at 40, constructed in accordance with the present invention. Dial 40 has a dial (i.e. "front") side and an actuation mechanism (i.e. a "movement" or "rear") side. In other words, the display indicators, such as seconds hand 52, minute hand 54 and hour hand 56 are positioned (although not shown to scale) on the front side of the dial 40, while the actuation mechanism(s) or movement assembly, generally indicated at 60, comprising stepper motors or the like and one or more gear assemblies rotatably engaged with the stepping motors to rotate the hands 52, 54, 56, is positioned on the rear side of the dial. The construction of a suitable movement 60 is well within the purview of one ordinarily skilled in the art.

Preferably and as illustrated in FIG. 3, the at least one concentrated light source 35 is positioned on the rear side of the dial, and the light from the at least one concentrated light source 35 is introduced into the transparent ring on the rear side of the dial, as indicated by arrow "A." The physical proximity of light source 35 to the ring 10, 20 is a matter of design choice. In a preferred embodiment, the geometries 12, 22 and/or 32 are positioned, in/on as the case may be, the transparent ring 10, 20 on at least the front side of dial 40, also illustrated in FIG. 3.

In accordance with an advantageous feature of the present invention, transparent ring 10, 20 preferably comprises an integrally molded support shoulder 15 about an inner periphery thereof. Preferably (but not necessarily), shoulder 15 extends around the entire inner periphery of ring 10, 20 and functions so as to support and/or maintain the positioning of the dial 40. This advantageous construction avoids the need for a separate support ring for the dial, thereby further reducing the number of parts needed herein.

Preferably, the at least one concentrated light source 35 is a light emitting diode (LED). Sample embodiments have shown that LEDs of different colors work quite well in illuminating the dial 40.

Timepiece 30 also comprises a printed circuit board 70 positioned on the rear side of dial 40. Preferably, the at least one concentrated light source 35 is mounted on the printed circuit board 70. An edge "E" of transparent ring 10, 20 is illustrated in each of the FIGS. 1, 2 and 3 for a clear understanding of the preferred orientation of ring 10, 20 in timepiece 30. Edge "E" is shown closest to crystal 80 of the timepiece 30. For completeness, FIG. 3 also illustrates a case back 90, a case 92 and a ring support 95 for supporting ring 10, 20.

Operation of the illumination of dial 40 is preferably achieved by activation of a switch, and may be attained by use of a switch that may be incorporated in a side pusher or in an assembly coupled to the crown of the timepiece, all as would be well within the purview of one skilled in the art. A microcontroller interface could also be utilized to initiate the illumination as also would be understood by one skilled in the art, as would also be the electrical circuit therefor. An alternate design may provide for the driving of the at least one concentrated light source 35 directly from a microcontroller (not shown), wherein the microcontroller would sense switch closure and in turn establish the voltage drive to the light source 35. Drive options such as duration and light pulses may be dictated by routine hardware and/or software implementation.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

For example, and as stated above, timepiece 30 incorporating the invention disclosed herein may be constructed as an analog watch, some examples of which are provided in FIGS.

4 and 5. Timepiece 30 could also be a combination analog and digital timepiece as would be understood in the art. Additionally, by incorporating either different color LED's or varying the color of the dial 40, different and/or multiple colors may be achieved to illuminate the dial 40. Still further, multiple light sources may be utilized for additional aesthetic effects.

Still further as the present invention is applicable for a varying number of watch styles and sizes, it should now be well understood that the geometries and patterning thereof in light guide 10, 20 may be arranged to manage and uniformly correct any shadowing effect that may occur upon a different size or shaped watch dial. Also, the shape and size of the geometries may vary as desired. For example, the protrusions and/or apertures may be square, round, rectangular or oval, just to name a few, with the importance being that their functionality provides for the directing of light out of the transparent ring and towards the dial, whereby the light directed out of the transparent ring by the light directing means illuminates the dial.

By utilizing the present invention, and in particular an illumination arrangement and watch incorporating same, that efficiently directs and distributes light so as to uniformly illuminate a timepiece dial, a compact and economical illumination arrangement for a timepiece can be achieved. It should also be understood that the term "timepiece" should be broadly interpreted to include any device capable of providing time functionality.

Moreover, reference to the phrase "positioned on the front side" (or "positioned on the rear side") of dial 40 is not intended to mean that such structure is physically "on" the dial, but rather simply as a reference point that is intended to mean more akin to "above" and/or "below" as the case may be. However, where the concentrated light source 35 is disclosed as being "mounted on" the PCB 70, this is preferably meant that in fact the light source 35 is mounted on and to the PCB 70.

And finally, it should be understood that the present invention improves the illumination of the dial, and that the present invention or the scope of the claims does not preclude the transparent ring itself from helping to illuminate the dial. That is, the invention improves the state of the art by specifically directing light out of the transparent ring via the light directing means or one or more "light directors" which is intended to refer to the same features herein.

It is also to be understood that the following claims are intended to cover all of the generic and specific features of the invention described herein and all statements of the scope of the invention which as a matter of language might fall therebetween.

What we claim is:

1. A timepiece that comprises at least one display hand for conveying information in an analog manner, the timepiece comprising:

a dial, the dial having a front side and a rear side, wherein the at least one display hand is positioned on the front side of the dial, and wherein the timepiece comprises an illumination assembly for illuminating the dial, the illumination assembly comprising:

a transparent and continuous ring into which light can be introduced, around and through which light can pass, wherein the transparent ring is positioned around the periphery of the dial, extending on the rear side of the dial and on the front side of the dial, wherein the transparent ring comprises an integrally molded support shoulder projecting inwardly from an inner periphery of the transparent ring for supporting the dial, and wherein the transparent ring extends beyond the front side of the dial and beyond the rear side of the dial;

at least one concentrated light source positioned on the rear side of the dial, for introducing light into the transparent ring wherein the light from the at least one concentrated light source is introduced into a portion of the transparent ring that is positioned on the rear side of the dial;

light directing means on the portion of the transparent ring that extends beyond the front side of the dial, located on at least one of the inner and the outer periphery of the transparent ring, for directing light out of the transparent ring and towards the dial, whereby the light directed out of the transparent ring by the light directing means illuminates the dial.

2. The timepiece as claimed in claim 1, wherein the light directing means comprises geometries in at least one of the inner and the outer periphery of the transparent ring to selectively eject light passing within the transparent ring.

3. The timepiece as claimed in claim 2, wherein the geometries include cut-out regions in at least one of the inner and the outer periphery of the transparent ring to selectively eject light passing within the transparent ring.

4. The timepiece as claimed in claim 2, wherein the geometries include apertures in at least one of the inner and the outer periphery of the transparent ring to selectively eject light passing within the transparent ring.

5. The timepiece as claimed in claim 2, wherein the geometries include protrusions formed on at least one of the inner and the outer periphery of the transparent ring to selectively eject light passing within the transparent ring.

6. The timepiece as claimed in claim 3, wherein the cut-out regions are in the outer periphery of the transparent ring to selectively eject light passing within the transparent ring.

7. The timepiece as claimed in claim 4, wherein the apertures are in the outer periphery of the transparent ring to selectively eject light passing within the transparent ring.

8. The timepiece as claimed in claim 2, wherein there are a plurality of geometries positioned about the transparent ring.

9. The timepiece as claimed in claim 1, wherein the at least one concentrated light source is at least one light emitting diode.

10. The timepiece as claimed in claim 9, including a printed circuit board on the rear side of the dial, and wherein the concentrated light source is mounted on the printed circuit board.

11. A timepiece that comprises at least one display hand for conveying information in an analog manner, the timepiece comprising:

a dial, the dial having a front side and a rear side, wherein the at least one display hand is positioned on the front side of the dial, and wherein the timepiece comprises an illumination assembly for illuminating the dial, the illumination assembly comprising:

a transparent and continuous ring into which light can be introduced, around and through which light can pass, wherein the transparent ring is positioned around the periphery of the dial, extending on the rear side of the dial and on the front side of the dial, wherein the transparent ring comprises an integrally molded support shoulder projecting inwardly from an inner periphery of the transparent ring for supporting the dial, and wherein the transparent ring extends beyond the front side of the dial and beyond the rear side of the dial;

at least one concentrated light source positioned on the rear side of the dial, for introducing light into the transparent ring wherein the light from the at least one concentrated light source is introduced into a portion of the transparent ring that is positioned on the rear side of the dial;

at least one light director on the portion of the transparent ring that extends beyond the front side of the dial, located on at least one of the inner and the outer periphery of the transparent ring, for directing light out of the transparent ring and towards the dial, whereby the light directed out of the transparent ring by the at least one light director illuminates the dial.

* * * * *